US006152347A

United States Patent [19]

Wilson et al.

[11] Patent Number: 6,152,347

[45] Date of Patent: Nov. 28, 2000

[54] VERTICAL STAPLER

[75] Inventors: Scott H. Wilson, Evanston; Sumir Kapur, Oak Park; Stephen D. Berry, Plainfield; Timothy E. McKeown, Glen Ellyn, all of Ill.

[73] Assignee: ACCO Brands, Inc., Lincolnshire, Ill.

[21] Appl. No.: 09/239,808

[22] Filed: Jan. 29, 1999

Related U.S. Application Data

[60] Provisional application No. 60/073,163, Jan. 30, 1998.

[51] Int. Cl.[7] ..... B25C 5/02

[52] U.S. Cl. ..... 227/134; 227/156; 227/120

[58] Field of Search ..... 227/120, 127, 227/128, 134, 132, 156

[56] References Cited

U.S. PATENT DOCUMENTS

| | | | |
|---|---|---|---|
| D. 110,801 | 8/1938 | Crosby . | |
| D. 116,706 | 9/1939 | Fancher et al. . | |
| D. 175,094 | 7/1955 | Ruskin | D74/1 |
| D. 186,342 | 10/1959 | Marano | D74/1 |
| D. 295,015 | 4/1988 | Ebihara | D8/50 |
| D. 306,684 | 3/1990 | Chan | D8/50 |
| D. 320,147 | 9/1991 | Mayo et al. | D8/50 |
| D. 333,957 | 3/1993 | Chan | D8/50 |
| D. 339,043 | 9/1993 | Chi | D8/50 |
| D. 352,434 | 11/1994 | Chi | D8/50 |
| D. 352,435 | 11/1994 | Chi | D8/50 |
| D. 394,194 | 5/1998 | Brunsdon et al. | D8/50 |
| D. 394,592 | 5/1998 | Brunsdon et al. | D8/50 |
| D. 401,825 | 12/1998 | Parsey et al. | D8/50 |
| D. 406,996 | 3/1999 | Matthes | D8/50 |
| D. 411,423 | 6/1999 | Huang | D8/50 |
| D. 411,725 | 6/1999 | Matthes | D8/50 |
| 2,240,911 | 5/1941 | Polzer et al. | 1/3 |
| 2,251,915 | 8/1941 | Crosby | 1/49 |
| 2,269,744 | 1/1942 | Tager et al. | 1/3 |
| 2,381,192 | 8/1945 | Vancura | 1/49 |
| 2,399,761 | 5/1946 | Ruskin | 1/3 |
| 2,511,944 | 6/1950 | Richards | 1/49 |
| 2,604,623 | 7/1952 | Ruskin | 1/3 |
| 2,658,197 | 11/1953 | Pankonin | 1/3 |
| 2,920,324 | 1/1960 | Kufel, Jr. et al. | 1/3 |
| 3,083,367 | 4/1963 | Ruskin | 1/3 |
| 3,640,443 | 2/1972 | Itagaki | 227/120 |
| 3,987,951 | 10/1976 | Thornhill | 227/120 |
| 4,014,493 | 3/1977 | Wolfe | 227/156 |
| 4,607,777 | 8/1986 | Ebihara | 227/120 |
| 4,666,075 | 5/1987 | Olesen | 227/128 |
| 4,706,865 | 11/1987 | Ebihara | 227/110 |
| 4,706,866 | 11/1987 | Ebihara | 227/120 |
| 4,717,062 | 1/1988 | Ebihara | 227/120 |
| 4,756,462 | 7/1988 | Ebihara | 227/120 |
| 4,784,307 | 11/1988 | Ebihara | 227/120 |
| 4,878,608 | 11/1989 | Mitsuhashi | 227/120 |
| 4,925,082 | 5/1990 | Kim | 227/120 |
| 4,949,893 | 8/1990 | Heckathron | 227/120 |
| 5,797,535 | 8/1998 | Lovegrove et al. | 227/120 |

*Primary Examiner*—Scott A. Smith
*Attorney, Agent, or Firm*—Pennie & Edmonds LLP

[57] ABSTRACT

A stapler that has a top member and a bottom member movably connected together. The bottom member includes a convex outer surface facing downwardly and being convex in lateral and longitudinal directions with a curvature generally conformed to a user's hand, and also a support portion disposed within the convex surface, having a common boundary therewith disposed generally in a flat plane and configured for supporting the stapler stably on a flat horizontal surface when the top member is biased towards the bottom member during stapling. A stapler mechanism is connected between top and bottom members. Support ends of the top and bottom members are configured for stably supporting the stapler in a vertical position on a flat surface. The stapler also a hinge shaft pivotably connecting the pivoting members together and a hinge cover covering the hinge shaft and having a flexible tab slidably associated with one of the top and bottom members for sliding with respect thereto when the pivoting members pivot.

20 Claims, 7 Drawing Sheets

VERTICAL STAPLER

This application claims the benefit of U.S. Provisional No. 60/073,163 filed Jan. 30, 1998.

FIELD OF THE INVENTION

The present invention relates to a hand-held stapler. More particularly, the present invention relates to a hand-held stapler that may stand vertically as well as horizontally on a desk top.

BACKGROUND OF THE INVENTION

By in large, staplers have been designed for sitting horizontally on a desk or counter top and have had generally flat top and bottom surfaces. For those staplers that have been designed as hand held, they are generally rounded on the top and bottom surfaces, thereby precluding them from acting as a desk-top stapler as well. For example, the Grip Stand-Up Stapler by Boston (Model No. 73080) is able to stand vertically, but cannot be used on a desk or counter top as the outer surfaces of the hinging stapler members are convex, which would cause the stapler to tip over.

SUMMARY OF THE INVENTION

The invention is directed to a hand-held stapler that can be used against a tabletop and also that can be stored vertically in a stable position on a flat surface for easy grasping. The outer surfaces of the stapler are concave laterally and longitudinally to fit within the palm of a user's hands, while the base of the stapler has an indented configuration to receive the user's finger tips and to seat the stapler stably against a horizontal flat surface. The front ends of the stapler are preferably blunt to additionally allow the stapler stand vertically. The stapler also has a flexible pivot cover that conceals a pivot shaft and can deform as the stapler is opened or closed.

DETAILED DESCRIPTION OF THE PREFERRED EMBODIMENTS

Figure 1:
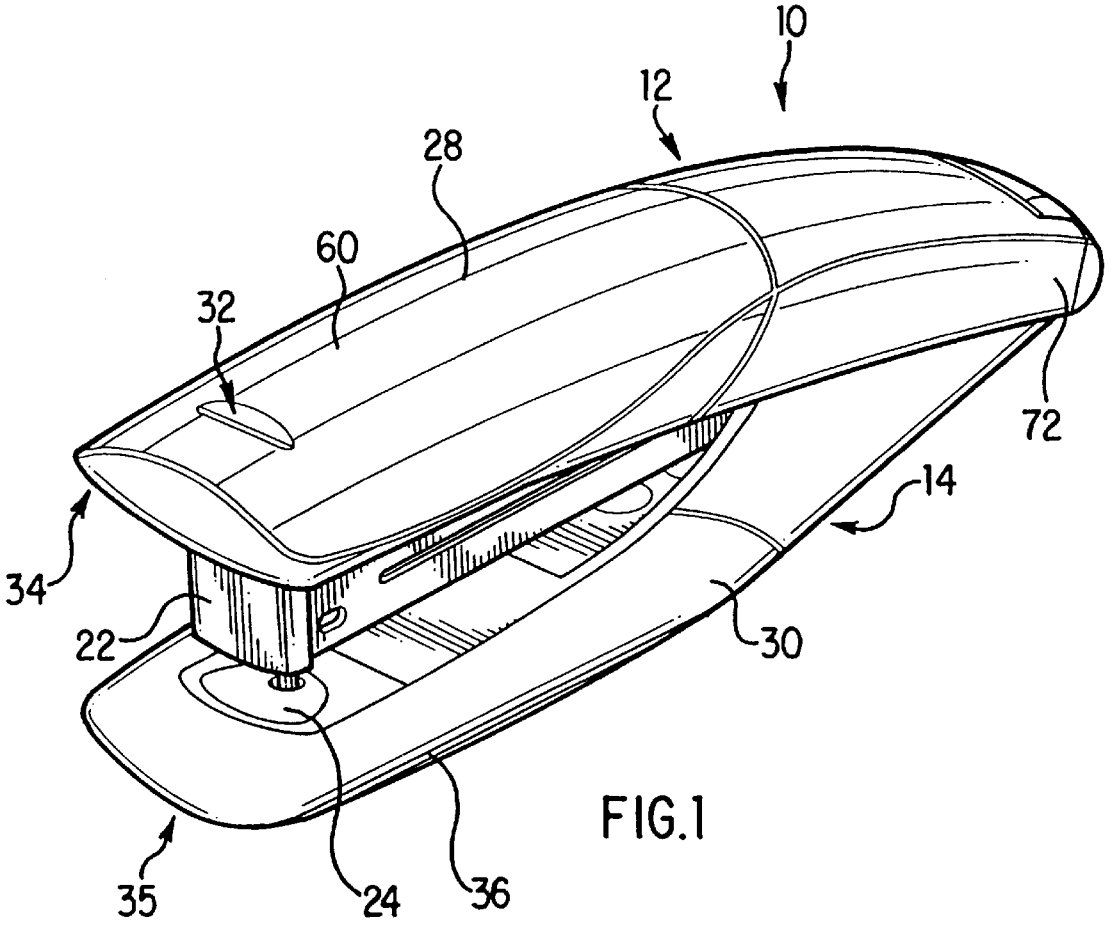
FIG. 1 is a top perspective view of a vertical stapler according to the present invention.
Figure 2:
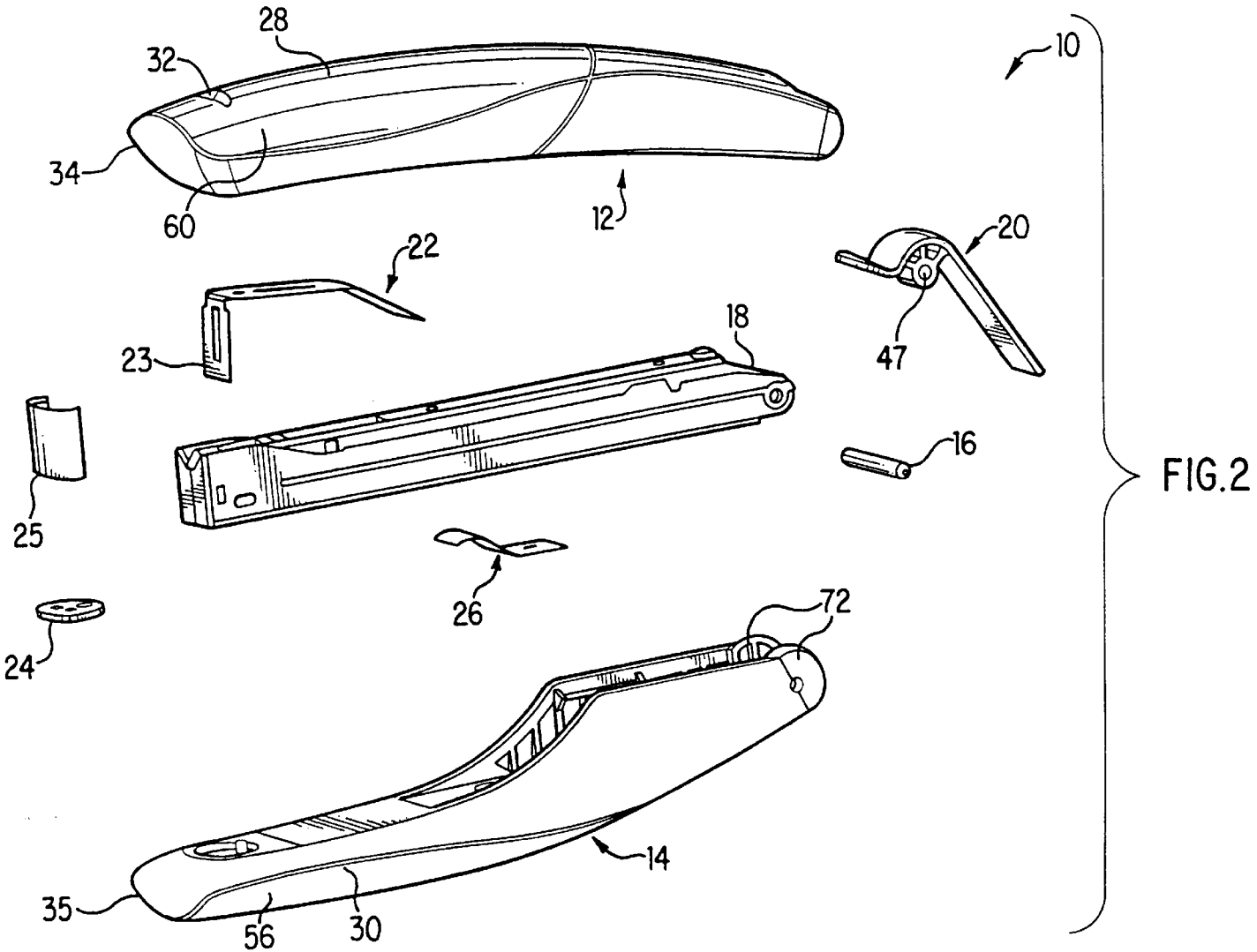
FIG. 2 is an exploded perspective of the stapler.

As shown in the figures, vertical stapler 10 has an top pivoting member, preferably a cap 12, and a lower pivoting member, preferably a base 14, pivotably connected to one another with a hinge shaft, which is preferably a pin 16. Also joined by the pin 16 are stapler magazine 18 and the 20, through which the hinge pin 16 is inserted.

Stapler 10 also has a hammer mechanism 22 with a staple driver 23 positioned between the stapler magazine 18 and the cap 12. The magazine 18 is configured for holding a plurality of staples 19 and feeding them, preferably with a spring biased pusher as is known in the art. The front portion of the stapler magazine 18 is covered by a nose piece 25. Upon activation of the stapler, when the cap 12 and base 14 are biased toward each other and moved together, or when the stapler mechanism connected to the cap is compressed, the driver 23 drives the staples through stapling space 29 between the cap 12 and base 14 a stack of papers 27 inserted into a stapling area 31 and the staple hits anvil 24 to finish the stapling action. The anvil 24 is aligned with the driver 23 and configured for bending legs of the staples 19 driven from the driver 23 against the stack 27. A spring 26 disposed between the cap 12 and base 14 assists in returning the cap 12 and stapling mechanism 17 to its normal position by biasing the magazine 18 and the base 14 away from each other.

The cap 12 and base 14 are constructed of ABS plastic and have a metal U-shaped bracket (not shown) that supports the side walls and hinge points in the stapler's cap 12 and base 14. The metal U-shaped bracket is welded inside the cap 12 and base 14, but may also be molded inside the ABS plastic. Additionally, the cap 12 and base 14 have a covering 28, 30 at the location where a user would grip the stapler. Preferably, the coverings 28, 30 are over-molded onto the cap 12 and base 14 and are made of an elastomer and, most preferably, of Santoprene™.

The covering 28 on cap 12 also has a staple action location guide 32 to help the user to locate the positioning of the stapling action. The guide 32 is a marking, preferably an indentation of the approximate size of the staples 19, preferably within 25%, and more preferably within 15% of the size thereof, for which the stapling mechanism 17 is configured to use, an located substantially directly above the driver 23 and the stapler that is aligned therewith to be stapled into the stack 27. The width 49 of the guide 32 is preferably within 25%, and more preferably within 15% of the width of the staples 19.

Figure 4:
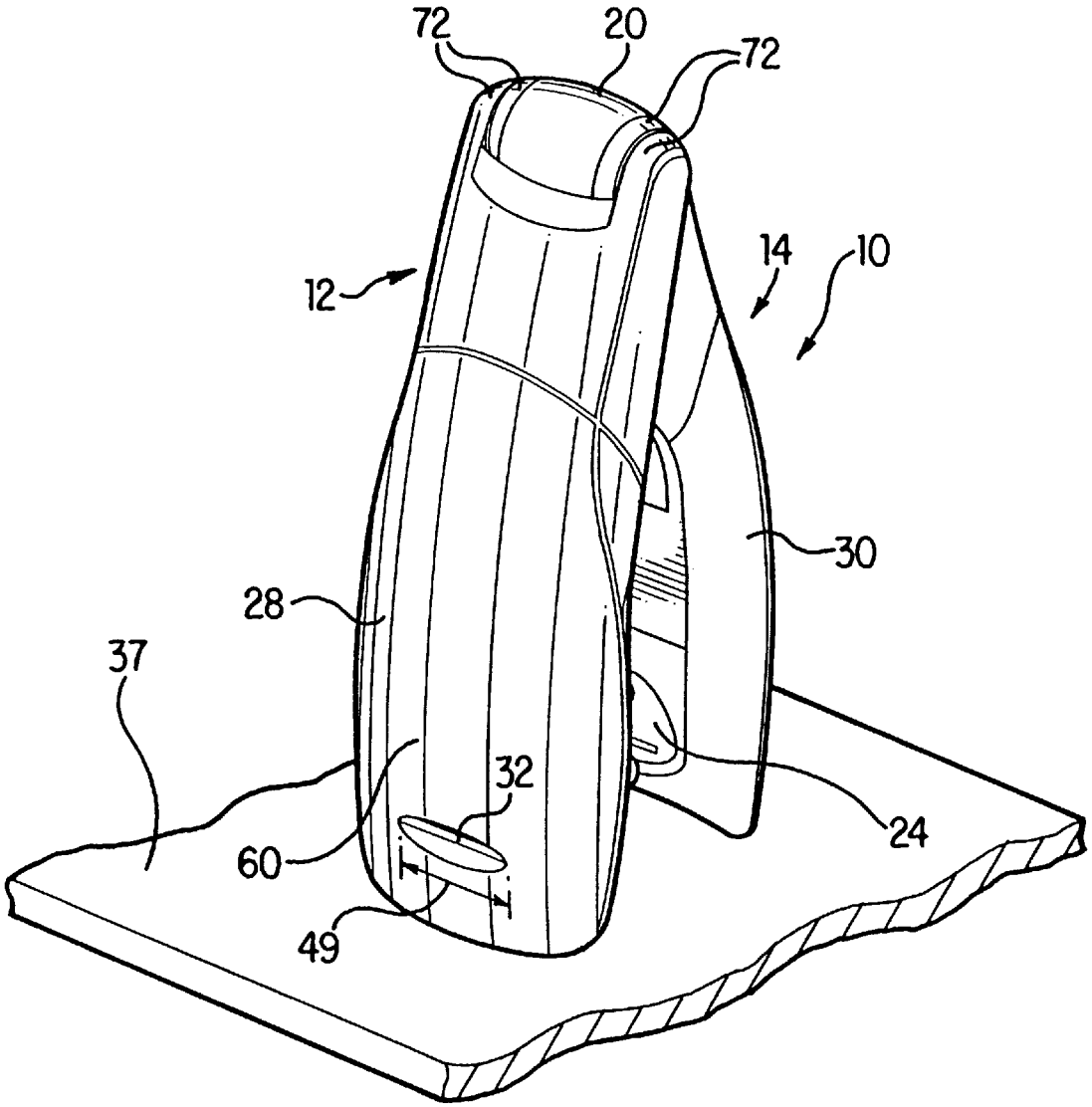
FIG. 4 is a top perspective view of the stapler standing in a vertical position.
Figure 5:
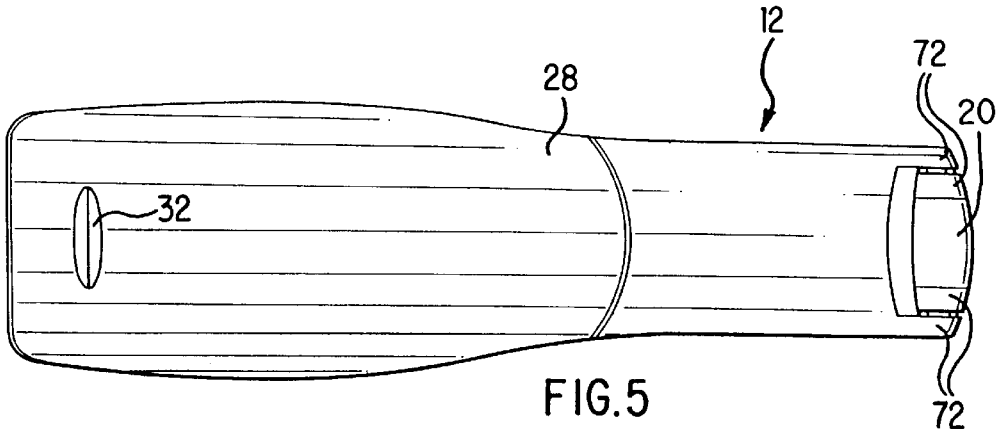
FIG. 5 is a top view thereof.

End portions 34 and 35 of the cap and base 12 and 14, respectively, located remotely from the pin 16, and preferably at an opposite end of the closed stapler 10 therefrom, are formed as blunt ends which allow the stapler 10 to be stored in a vertical position on a flat, horizontal surface 37, as shown in FIG. 4. Storing the stapler 10 in this position reduces the amount of space taken up on the user's desk or tabletop. Additionally, with the stapler 10 sitting on the ends 34, 35 of the cap 12 and base 14, it is easier for the user to locate, to grab a hold of, and staple papers quickly. The blunt ends 34 and 35 preferably are substantially planar or have a curvature with a radius 39 sufficiently large to support the stapler stably on the surface 37, as shown in FIG. 5. Thus, the center of gravity of the stapler is located over the ends 34 and 35 and at a shorter distance from the ends 34 and 35 than the length of the radius 39.

Figure 3:
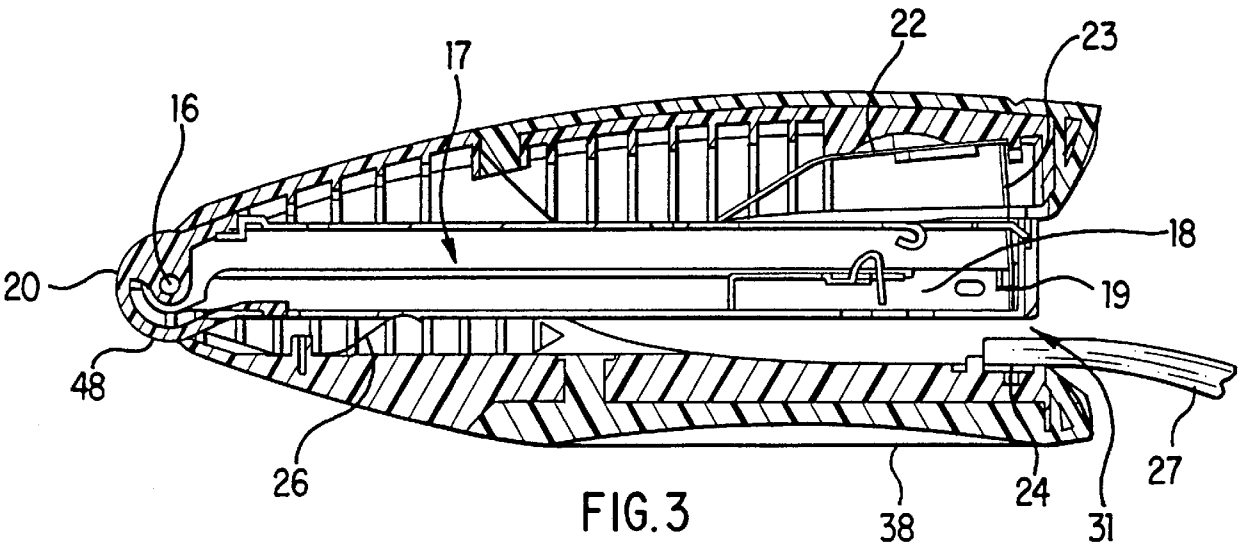
FIG. 3 is a side cross-sectional view thereof.
Figure 6:
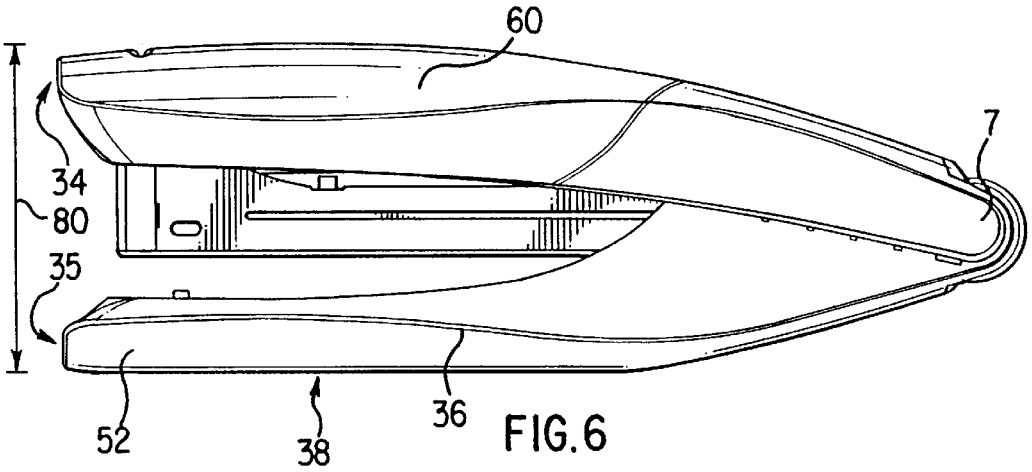
FIG. 6 is a side view thereof.
Figure 7:
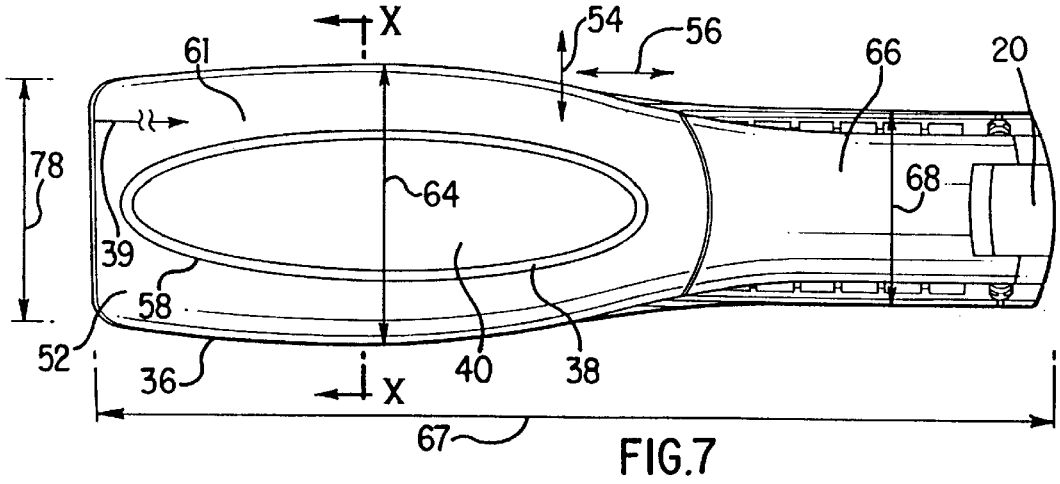
FIG. 7 is bottom view thereof.
Figure 8:
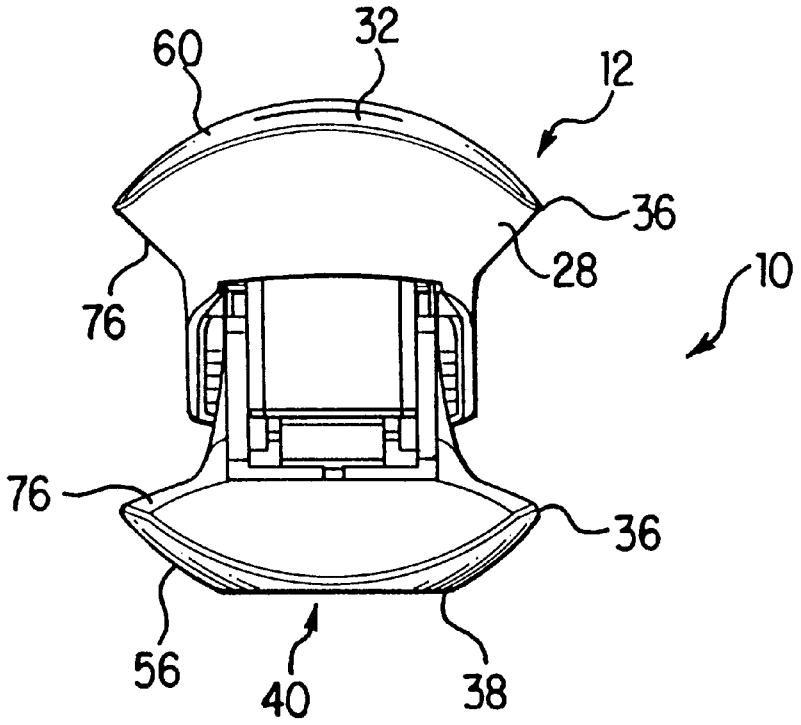
FIG. 8 is a front end view thereof.
Figure 9:
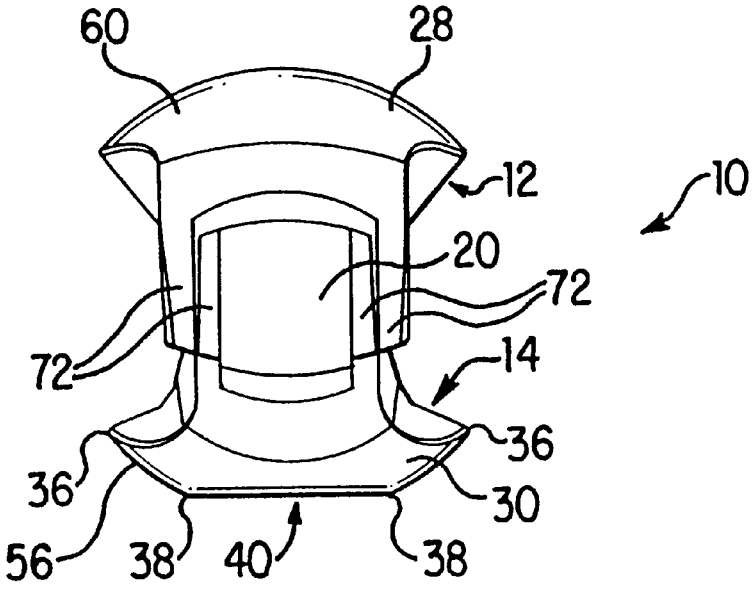
FIG. 9 is a rear end view thereof.

Referring to FIGS. 3, 5, and 6, the base covering 30 on base 14 is sloped downward from the outside edge 36 to a oval-shaped region 38 to a recessed concave area 40 where a user would place their finger tips during actuation of the stapler. Area 40 provides a flat stable surface and keeps the stapler 10 well balanced and stable in a horizontal orientation, supporting the stapler 10 on the flat surface during stapling, when the cap 12 is forced against the base 14. The base 14 thus has a convex outer surface 52 facing downwardly, which is convex in lateral and longitudinal directions 54 and 56, with a curvature generally conformed to a user's hand, to facilitate grasping of the base during handheld stapling. The oval region 40 is a support portion disposed within the convex surface 52 and has a common boundary 58 therewith. The recessed portion 40 is sloped upwardly from support portion 38 and is preferably concave in the lateral and longitudinal directions 54 and 56 with a curvature sufficient to receive and stabilize a user's fingers or thumb. The oval support portion 38 has a downwardly facing surface disposed generally in a flat plane. The oval region 38 is disposed below the driver 23 and below the portion of the cap 12 to which a user will apply the force to bring the cap 12 and base 14 together. Also, the oval region 38 is disposed below the center of gravity of the stapler, preferably with and without staples 19, to stably balance the stapler. Therefore, the stapler 10 is also used as a desk-top or table-top stapler in this horizontal position by inserting the pages in the stapling area or space 31 and actuating the stapler by pressing on the cap 12. The cap 12 preferably also has a top outer surface 60 facing upwardly and being convex in the longitudinal and lateral directions with a curvature generally conformed to a user's hand.

A forward portion 61 of the cap 12 and base 14, leading to the ends 34 and 35 and occupying at least about one third of the length 62 of the stapler 10, extends laterally to a first width 64. A rearward portion 66 of the cap 12 and base 14, leading to the pivoting side of the stapler 10 and occupying at least about one third of the length 62, has a second width 68 that is narrower than the first width 64. This provides increased width to the ends 34 and 35 to improve the stability of the stapler 10 in the vertical position, and also improves the gripability by a user with the palm positioned generally around the rearward portion 66 and the fingers positioned around the forward portion 61 thereof. To improve the vertical stability of the stapler, the width 78 of the ends 34 and 35 is preferably more than about 50% of the height 80 of the stapler 10, and more preferably greater than about 70 when the stapler is in a normally assumed closed position as shown.

The inner surfaces 76 of the cap 12 and base 14 are preferably sloped towards the outside edges 36 to facilitate insertion of a stack of paper into the stapling space. This is particularly useful when the stapler is held by hand.

Figure 10:
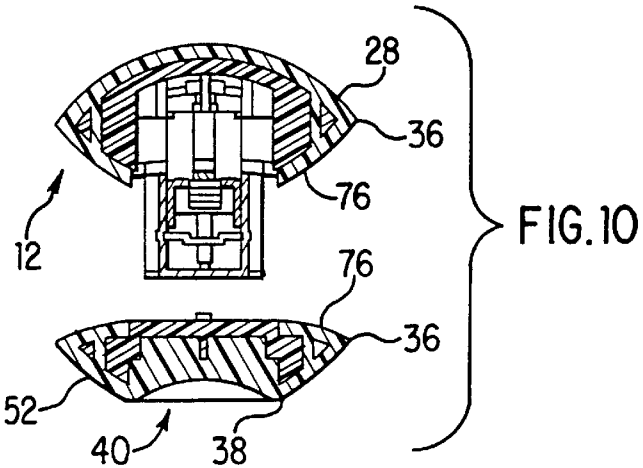
FIG. 10 cross-sectional view at plane X—X of FIG. 7.
Figure 11:
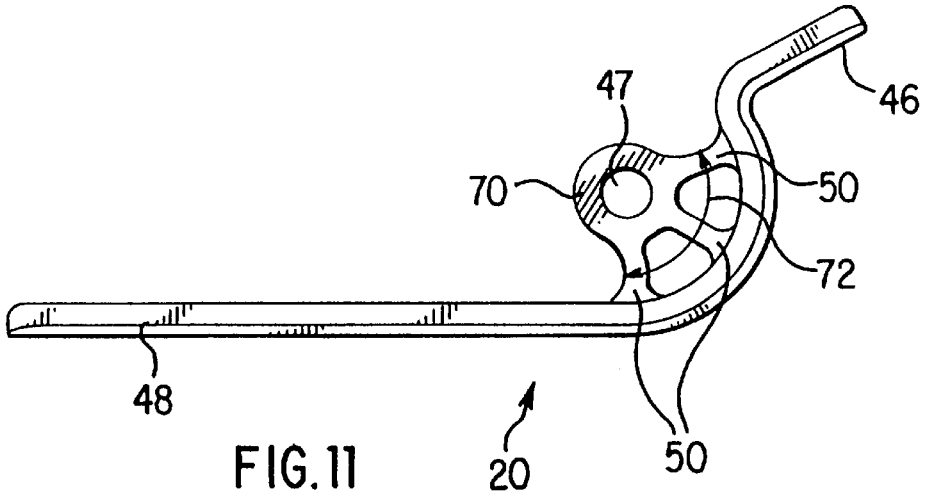
FIG. 11 is a side view of an idler of the stapler.
Figure 13:
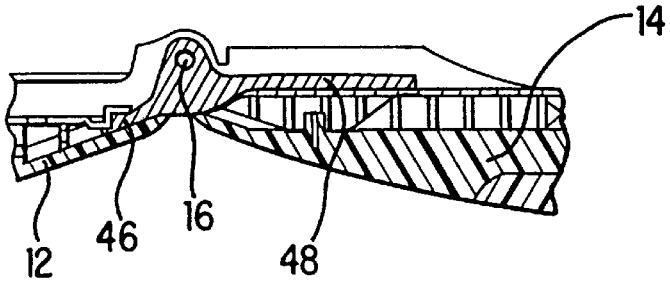
FIG. 13 is a cross-sectional view of the stapler open to about 180°.
Figure 12:
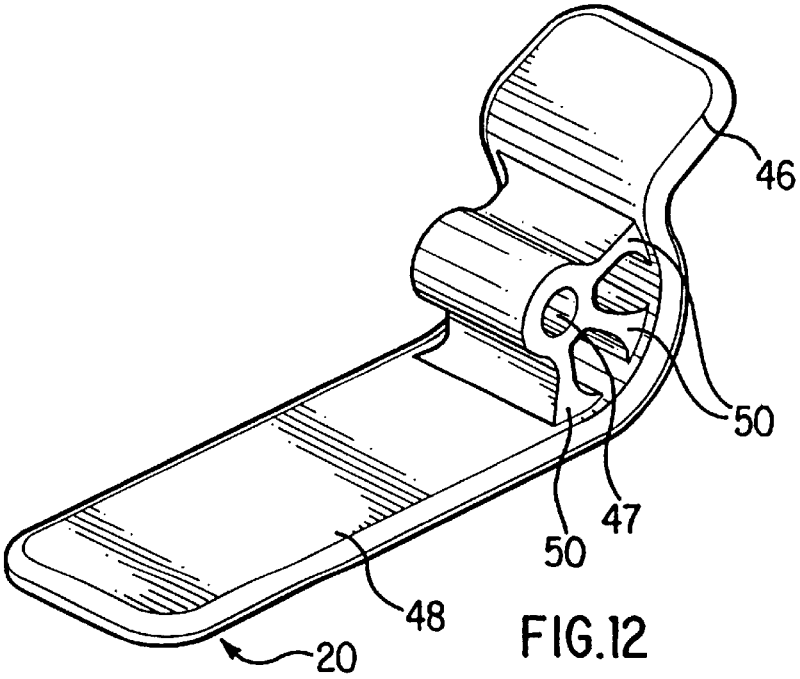
FIG. 12 is a perspective of the idler.

The stapler 10 also has, as shown in FIGS. 11 and 12, a hinge cover or idler 20 having a hole 47 through which the hinge pin 16 is inserted. The idler 20 is preferably made from a molded plastic and most preferably polypropylene to allow for easy deformation of the idler 20 as the stapler opens and closes. The idler 20 also functions to hide the hinge pin 16. Top tab 46 of idler 20 is inserted into the cap 12 of the stapler and lodges against the underside of cap 12, providing an interference or frictional fit. The bottom tab portion 48 is inserted into the base 14 of the stapler 10. The flat bottom tab portion 48 is allowed to move freely in and out of the base 14, preferably sliding along the inside, top surface of the base 14 when the stapler 10 is opened and closed. The idler 20 of FIGS. 11 and 12 have ribs 50 that extend from a cylindrical, central, tube portion 70, the hole 47 of which rotatably receives the pin 16, support the outer surface of the idler 20 and also are deformable to allow deformation of the idler 20 as the stapler 10 is opened and closed. The configuration of the idler 20, along with the cap 12 and base 14 of the stapler 10, allow the stapler to be opened to approximately 180° to allow for a tacking function, as shown in FIG. 13. The tabs 46 and 48 have a normally assumed position shown in FIGS. 11 and 12 selected such that they bent inwardly by the base and cap to ensure proper positioning in the open stapler position of FIG. 10. Since the idler 20 is made of polypropylene, the opening and closing of the stapler does not cause undue stress on the idler 20. Instead of a plurality of ribs, the idler 20 of FIG. 3 has only a single wide rib.

The ribs are disposed around the tube 70 over an angle 72 of preferably around 90° or less, and more preferably of about 100°. This allows the tabs 46 and 48 to bend more easily from adjacent the nearest rib 50. The idler 20 is preferably of unitary construction, and covers the area between clevis arms 74 of the cap 12 and base 14, which are preferably closed to conceal the pin 16 and the pivot area of the stapler 10.

One of ordinary skill in the art can envision numerous variations and modifications. All of these modifications are contemplated by the true spirit and scope of the following claims.

What is claimed is:

1. A stapler, comprising:

(a) a top member;

(b) a bottom member connected to the top member movably towards and away therefrom, the top and bottom members defining a stapling space therebetween dimensioned to receive a stack, the bottom member including:

(i) a convex outer surface facing downwardly and being convex in lateral and longitudinal directions with a curvature generally conformed to a user's hand;

(ii) a support portion disposed within the convex surface, having a common boundary therewith disposed generally in a flat plane and configured for supporting the stapler stably on a flat horizontal surface when the top member is biased towards the bottom member during stapling; and (c) a stapler mechanism connected between top and bottom members and configured for stapling staples through the stack located in the stapling space when the top and bottom members are biased towards each other.

2. The stapler of claim 1, wherein:

(a ) the stapler mechanism includes a staple driver configured for driving the staplers through the stapling space; and (b) the support portion is disposed beneath the driver.

3. The stapler of claim 1, wherein the boundary is generally oval.

4. The stapler of claim 1, wherein the support portion includes a concave surface disposed within the boundary and curved upwardly from the support portion.

5. The stapler of claim 4, wherein the concave surface is concave in the longitudinal and lateral directions.

6. The stapler of claim 4, where in the con cave surface has a curvature sufficient for receiving and stabilizing fingers of a user for compressing the top and bottom members toward each other.

7. The stapler of claim 1, wherein the top and bottom members are pivotably connected to each other.

8. The stapler of claim 7, wherein:

(a) the top and bottom members are pivotably connected at a pivot; and (b) the top and bottom members include support ends disposed longitudinally remotely from the pivot and configured for stably supporting the stapler in a vertical position on a flat surface with the longitudinal direction oriented vertically.

9. The stapler of claim 8, wherein:

(a) the support ends have a first width;

(b) the top and bottom members have a second width at the pivot, the first width being wider than the second width for increasing the stability of the stapler in the vertical position.

10. The stapler of claim 1, wherein the top member has a top outer surface facing upwardly and being convex in the longitudinal and lateral directions with a curvature generally conformed to a user's hand.

11. The stapler of claim 10, wherein the top and bottom members have inner surfaces facing the stapling space which are sloped towards the outer surfaces of the top and bottom members respectively for facilitating insertion of the stack in to the stapling space.

12. A stapler, comprising:

(a) a top member including:

(i) a staple magazine configured for holding a plurality of staples, and (ii) a staple driver; and (b) a bottom member connected to the top member movably towards and away therefrom and associated with the top member to define a space therebetween for receiving a stack, the bottom member including:

(i) an anvil disposed beneath the driver, wherein the driver is associated with the magazine and the anvil for driving the staples from the magazine through the stack and towards the anvil, the anvil being aligned with the driver and configured for bending legs of the staples driven from the driver against the stack, (ii) a convex outer surface facing downwardly and being convex in lateral and longitudinal directions with a curvature generally conformed to a user's hand, and (iii) a support portion disposed within the convex surface beneath the anvil, having a common boundary therewith disposed generally in a flat plane and configured for supporting the stapler stably on a flat horizontal surface when the top member is biased towards the bottom member during stapling.

13. A stapler, comprising:

(a) a top member that includes a top support end;

(b) a bottom member connected at a pivot to the top member pivotably towards and away therefrom, the top and bottom members defining a stapling space therebetween dimensioned to receive a stack, the bottom member including:

(i) a convex outer surface facing downwardly and being convex in lateral and longitudinal directions with a curvature generally conformed to a user's hand, (ii) a support portion disposed facing downwardly disposed generally in a flat plane and configured for supporting the stapler stably on a flat horizontal surface when the top member is biased towards the bottom member during stapling, and (iii) a bottom support end, wherein the top and bottom support ends are disposed longitudinally remotely from the pivot and configured and located for stably supporting the stapler in a vertical position on a flat surface with the longitudinal direction oriented generally vertically; and (c) a stapler mechanism connected between top and bottom members and configured for stapling staples through the stack located in the stapling space when the top and bottom members are biased towards each other.

14. A stapler, comprising:

(a) a top member including a first top support surface in a first plane;

(b) a bottom member having a first bottom support surface disposed opposite from the first top support surface and in the first plane, wherein the first top and bottom support surfaces are configured and located for cooperatively stably supporting the stapler in a first position with the first plane disposed generally horizontally, the bottom member being connected to the top member movably towards and away therefrom at a location remote in a longitudinal direction from the first support surfaces, the top and bottom members defining a space therebetween dimensioned to receive a workpiece, the bottom member including:

(i) a convex outer bottom surface facing downwardly and being convex in the longitudinal direction and in a lateral direction with a curvature generally conformed to a user's hand, and (ii) a second support surface disposed generally in a second plane and configured for supporting the stapler stably in a second position with the second plane disposed generally horizontally; and (c) a stapler mechanism connected between top and bottom members and configured for stapling staples through the workpiece located in the stapling space when the top and bottom members are biased towards each other.

15. The stapler of claim 14, wherein:

(a) the stapler has a longitudinal axis generally normal to the first plane;

(b) the first plane is disposed such that the longitudinal axis is generally vertical in the first position; and (c) the second plane is disposed such that the longitudinal axis is generally horizontal in the second position.

16. The stapler of claim 14, wherein the top member comprises a convex outer top surface facing downwardly and being convex in the longitudinal direction and in a lateral direction with a curvature generally conformed to a user's hand.

17. The stapler of claim 16, wherein the first top support surface is fixed with respect to convex outer top surface.

18. The stapler of claim 16, wherein the convex outer top and bottom surfaces are connected together by a single pivot.

19. The stapler of claim 14, wherein the second support surface is fixed with respect to the convex outer bottom surface.

20. The stapler of claim 14, wherein the top support end is substantially pivotably free from the bottom member.

* * * * *